US009392878B2

(12) United States Patent
Ko

(10) Patent No.: US 9,392,878 B2
(45) Date of Patent: Jul. 19, 2016

(54) MULTI-FUNCTIONAL SUPPORTING CUSHION

(71) Applicant: TEST RITE INTERNATIONAL COMPANY, LTD., Taipei (TW)

(72) Inventor: Fu-Lung Ko, Taipei (TW)

(73) Assignee: TEST RITE INTERNATIONAL COMPANY, LTD., Taipei (TW)

( * ) Notice: Subject to any disclaimer, the term of this patent is extended or adjusted under 35 U.S.C. 154(b) by 88 days.

(21) Appl. No.: 14/282,066

(22) Filed: May 20, 2014

(65) Prior Publication Data

US 2015/0157134 A1 Jun. 11, 2015

(30) Foreign Application Priority Data

Dec. 5, 2013 (TW) ..... 102144559 A

(51) Int. Cl.

| | |
|---|---|
| ***A47C 27/15*** | (2006.01) |
| ***A47C 7/38*** | (2006.01) |
| ***A47C 7/42*** | (2006.01) |
| ***A47C 20/02*** | (2006.01) |
| ***A47G 9/10*** | (2006.01) |

(52) U.S. Cl.

CPC ..... *A47C 27/15* (2013.01); *A47C 7/383* (2013.01); *A47C 7/425* (2013.01); *A47C 20/027* (2013.01); *A47G 9/1081* (2013.01); *A47G 2009/1018* (2013.01)

(58) Field of Classification Search

CPC ..... A47C 27/15; A47C 20/027; A47C 7/425; A47C 7/383; A47G 9/1081; A47G 2009/1018; A47G 9/10

See application file for complete search history.

(56) References Cited

U.S. PATENT DOCUMENTS

| | | | | | |
|---|---|---|---|---|---|
| 3,118,153 | A * | 1/1964 | Hood | A47C 27/15 | 297/DIG. 1 |
| 4,108,492 | A * | 8/1978 | Kirby | A47C 7/021 | 297/284.3 |
| 4,766,627 | A * | 8/1988 | Landry | A47C 20/027 | 5/630 |
| 4,959,880 | A * | 10/1990 | Tesch | A47G 9/10 | 5/490 |
| 5,070,558 | A * | 12/1991 | Fenley | A47G 9/10 | 5/490 |
| D602,299 | S * | 10/2009 | Heroux | D6/601 | |
| 7,797,773 | B1 * | 9/2010 | Wilk | A47C 7/383 | 5/640 |
| D629,178 | S * | 12/2010 | Lindsay | D2/824 | |
| D715,581 | S * | 10/2014 | Kawamura | D6/601 | |
| 2002/0113482 | A1 * | 8/2002 | Clegg | A47C 7/383 | 297/391 |
| 2003/0159217 | A1 * | 8/2003 | Clemons | A47G 9/10 | 5/636 |
| 2012/0313417 | A1 * | 12/2012 | Hurwitz | B60N 2/4879 | 297/391 |
| 2014/0310877 | A1 * | 10/2014 | Sternlight | A47G 9/10 | 5/639 |

* cited by examiner

*Primary Examiner* — David E Sosnowski
*Assistant Examiner* — Myles Throop
(74) *Attorney, Agent, or Firm* — Bacon & Thomas, PLLC

(57) ABSTRACT

This invention provides a multi-functional supporting cushion, comprising: a plurality of pad portions, each of which having a circularly curved top end, the pad portions at the center being higher than those on both sides such that the top ends of the plurality of pad portions form a wave-shaped contour descending from the center toward both sides, a bolster being selectively formed from the plurality of pad portions or the plurality of pad portions being constricted from respective free ends of the two pad portions at both sides to make a circular loop. The supporting cushion allows a user's back, waist and neck to rest thereon or to be supported thereby. The supporting cushion is capable of supporting the user's head when serving as a neck cushion. It is put around the neck to protect the cervical vertebrae, support the nape of the neck and prevent the users head from falling aside. The supporting cushion is placed on the chair to provide comfortable support for the users waist and back when serving as a waist and back cushion.

7 Claims, 10 Drawing Sheets

MULTI-FUNCTIONAL SUPPORTING CUSHION

BACKGROUND OF THE INVENTION

1. Field of the Invention

The present invention relates to a multi-functional supporting cushion, and more particularly, to a multi-functional supporting cushion whose uniquely designed pad portions are configured to allow the user's back, waist and neck to rest or be supported.

2. Description of the Prior Art

Pillows are necessities for most people. With the increasing demand for better sleep quality, more and more people unleash their creativity to design products that fulfill the diversified needs of users. As people require better sleep quality and rest not only at home but also in workplaces, such as offices and studios, or public places, such as classrooms, buses and MRT trains, a variety of relevant products have been developed to satisfy such needs. For example, a neck cushion can provide comfortable support while the user is at work or rest, standing or sitting, in offices, studios, buses or MRT trains. As cushions are widely used at home or in cars, there is a need to further improve their design.

In today's modern living environment, people reply on various means of conveyance, such as cars or flights, for business or recreational trips. For a long distance journey, passengers will spend a long time on the transportation, thus some may choose to read books or newspapers, play electronic devices such as mobiles or handheld game consoles, or prepare for work while others may take rest so as to deal with the upcoming events.

For the comfort of passengers, some transportations are equipped with well designed chairs so that passengers can lie down comfortably. These chairs, however, are not customized but made in mass production and arranged at relatively narrow intervals, thus they can hardly make the journey a comfortable experience. Therefore, a variety of peripheral products, such as back cushions, hug pillows, head rests or cervical pillows that are placed around the users' necks, have been developed for improving the comfort of the journey. Nevertheless, these products are too simple to provide any protection and require improvement.

SUMMARY OF THE INVENTION

Therefore, there is a need to develop a multi-functional supporting cushion capable of protecting the neck and preventing the head from falling aside so that the user can rest or sleep safely and soundly and the probability that the user injures his/her head or neck will reduce. Moreover, the multi-functional supporting cushion can provide comfortable support for the user's waist or back. In addition, the present invention can be folded and compressed to a smaller size when not being used so that the user can carry it conveniently during the trip.

The present invention provides a multi-functional supporting cushion, comprising: a plurality of pad portions, each of which having a circularly curved top end, the pad portions at the center being higher than those on both sides such that the top ends of the plurality of pad portions form a wave-shaped contour descending from the center toward the two sides, a bolster being selectively formed from the plurality of pad portions or the plurality of pad portions being constricted from respective free ends of the two pad portions at both sides to make a circular loop.

Preferably, the plurality of pad portions of the cushion comprise an outer case, an inner case and at least one foam. The at least one form is received in the inner case, and the at least one foam and the inner case are received in the outer case.

Preferably, the outer case has a first opening at which at least one first joining element is provided, and the inner case has a second opening at which at least one second joining element is provided.

It is preferable that the outer case comprises a string and a fastening element and an interior surface thereof is provided with a plurality of string through holes, that the string is threaded through the outer case, the plurality of string through holes and the fastening element, and that the cushion can be constricted by drawing up the string and clasping the string with the fastening element.

Preferably, the string is threaded through the plurality of string through holes arranged at different heights on the outer case so as to adjust the height position of the string.

Preferably, the at least one foam is a memory foam.

Preferably, the at least one foam is a high resilience (HR) foam.

It is preferable that the plurality of pad portions comprise a first pad portion, a second pad portion and a third pad portion, and that a recess is defined between the first pad portion and the second pad portion to accommodate the user's ear and thereby to make the user more comfortable.

Preferably, the at least one first joining element of the outer case is a button, and the at least one second joining element of the inner case is a button.

Preferably, the at least one first joining element of the outer case is a hook and loop fastener, e.g. Velcro patch, and the at least one second joining element of the inner case is a hook and loop fastener, e.g. Velcro patch.

DETAILED DESCRIPTION OF THE PREFERRED EMBODIMENTS

While this invention will be fully described with preferred embodiments by reference to the accompanying drawings, it is to be understood beforehand that those skilled in the art can make modifications to the invention described herein and attain the same effect, and that the description below is a general representation to those skilled in the art and is not intended to limit the scope of the present invention.

Figure 1:
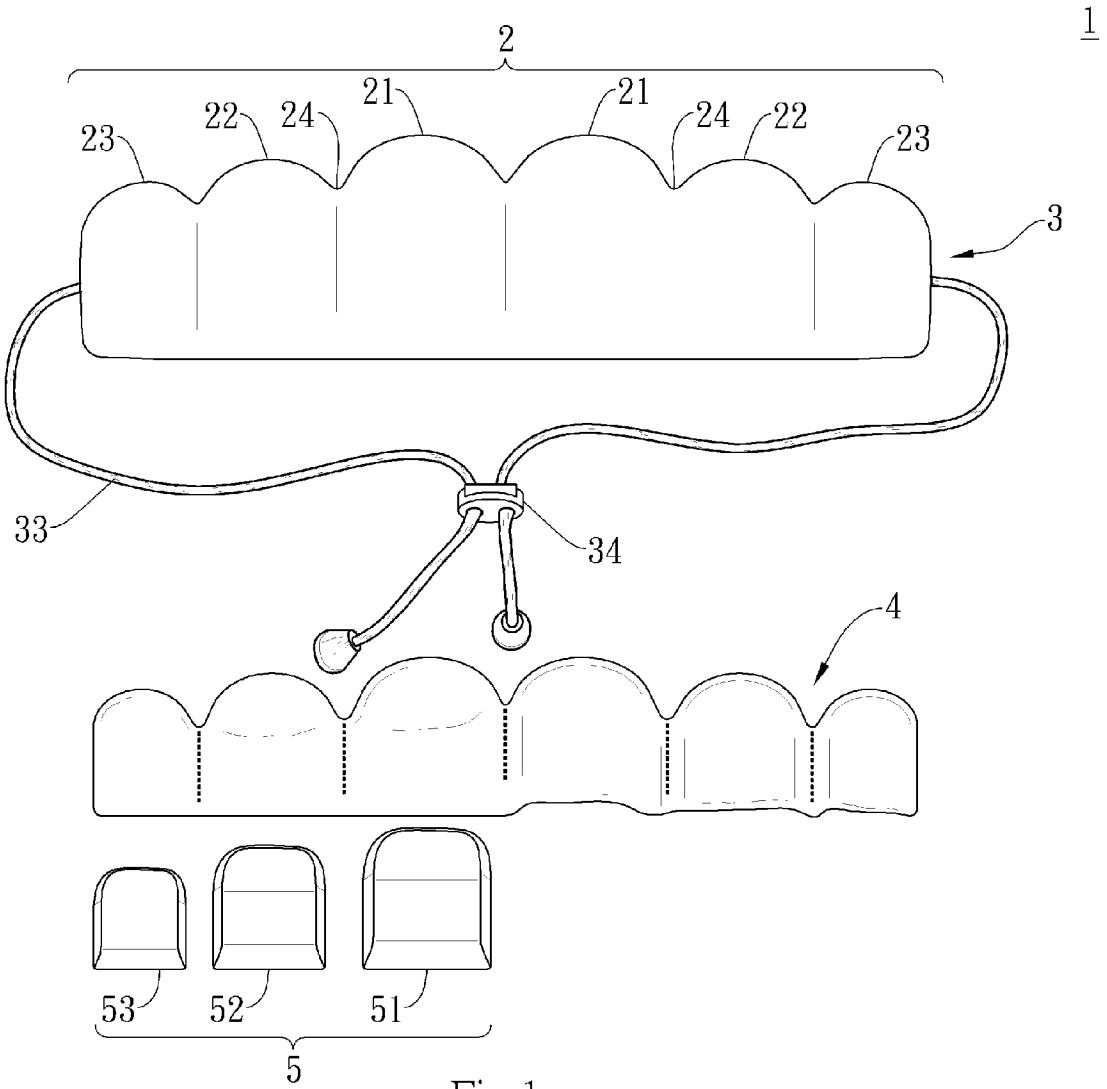
FIG. 1 is an exploded view showing a multi-functional supporting cushion of the present invention.
Figure 2:
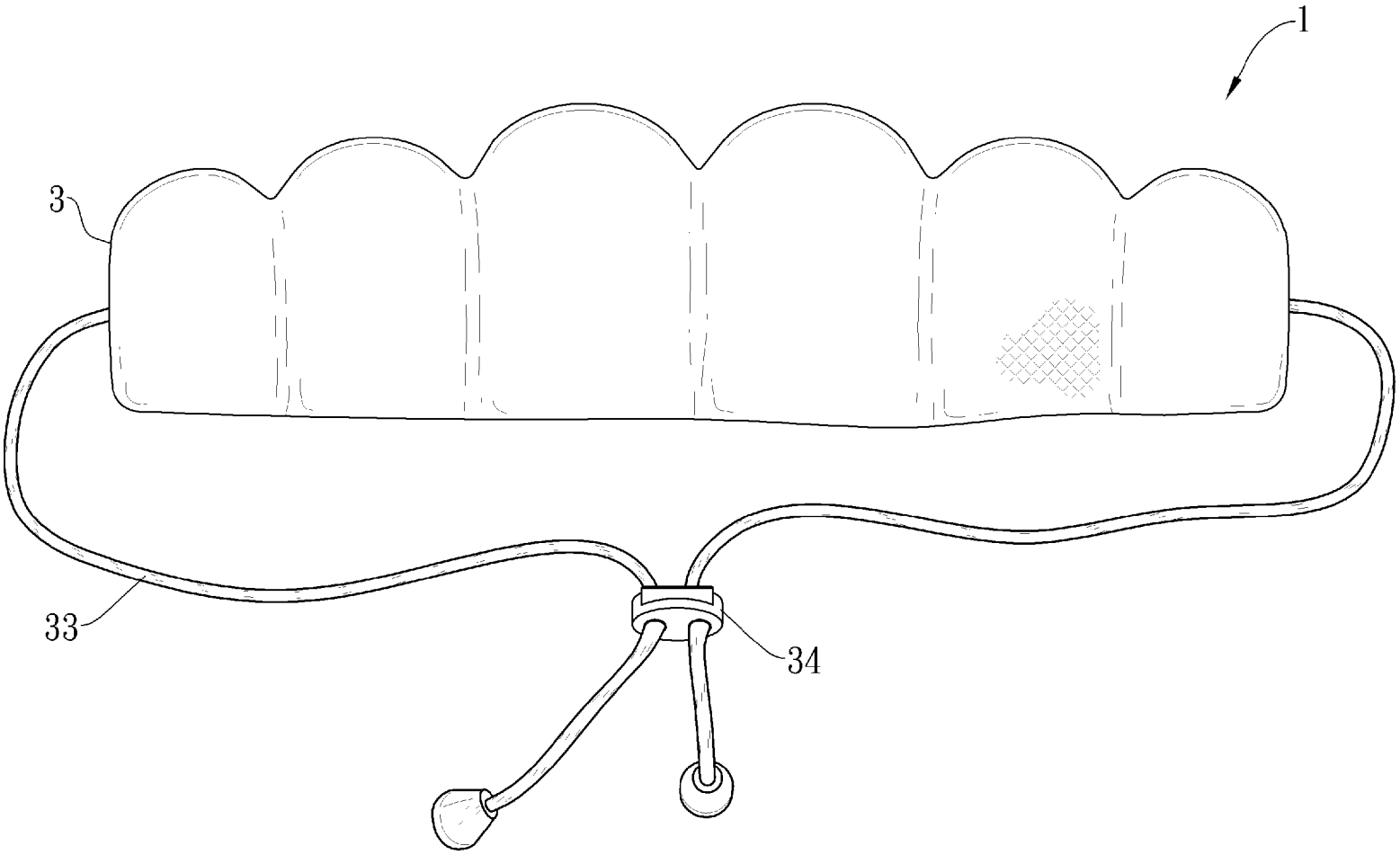
FIG. 2 is an assembly view showing a multi-functional supporting cushion of the present invention.
Figure 3:
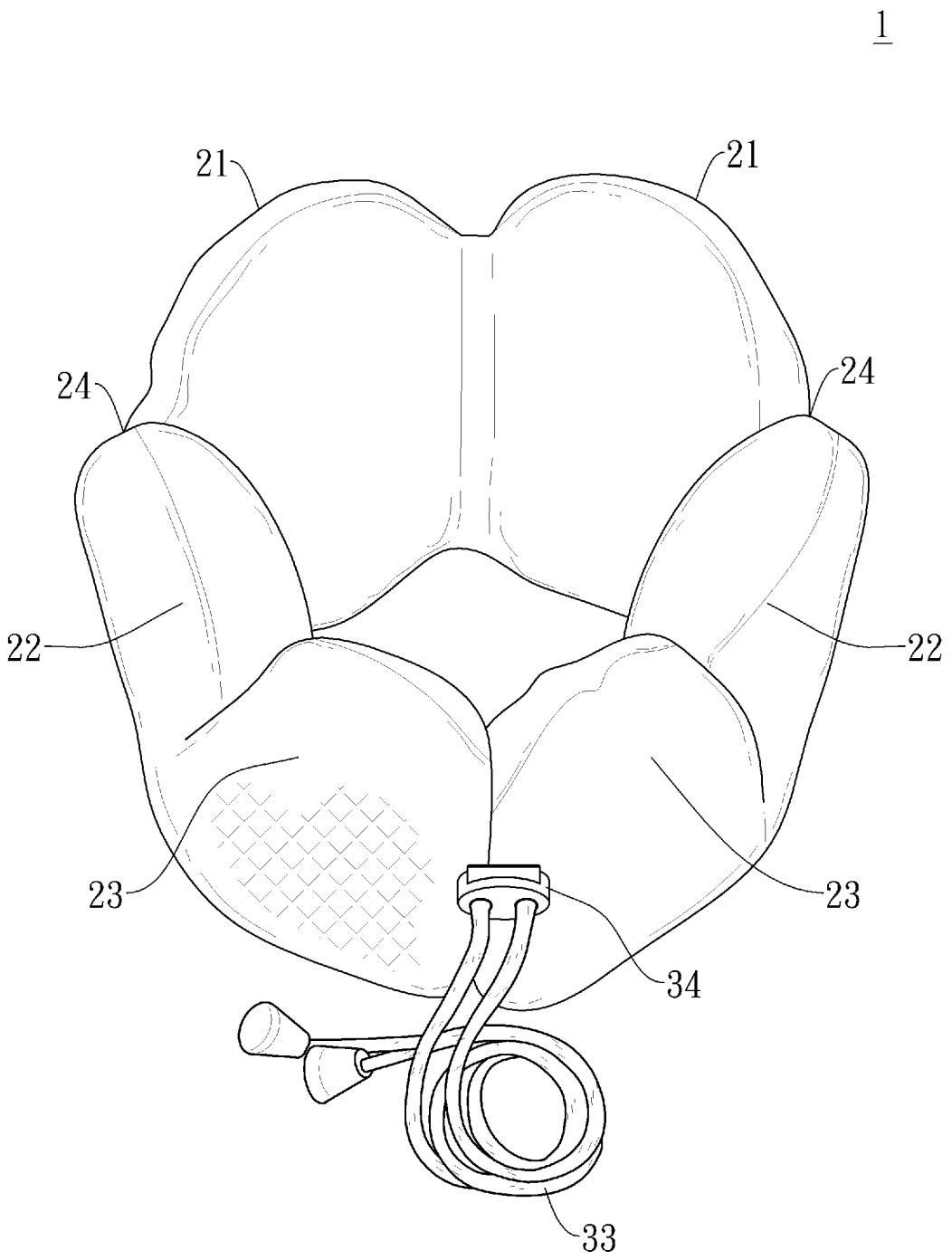
FIG. 3 is a perspective view showing a multi-functional supporting cushion of the present invention under the state of being used.

FIGS. 1 and 2 are an exploded view and an assembly view of a multi-functional supporting cushion of the present invention. The present invention provides a multi-functional supporting cushion 1, comprising: a plurality of pad portions 2 consisting of a first pad portion 21, a second pad portion 22 and a third pad portion 23. Each of the first pad portion 21, the second pad portion 22 and the third pad portion 23 has a circularly curved top end, and a recess 24 is defined between the first pad portion 21 and the second pad portion 22. The plurality of pad portions 2 of the multi-functional supporting cushion 1 comprise an outer case 3, an inner case 4 and at least one foam 5. The at least one foam 5 is received in the inner case 4, and the at least one foam 5 and the inner case 4 are in turn received in the outer case 3. Referring to FIG. 1, it is worth mentioning that the foam 51 received in the first pad portion 21 is a memory foam or an inert foam. When the multi-functional supporting cushion 1 is being used, the foam 51 can ease the uncomfortable feeling caused by the vibration generated when cars or aircrafts are on the move. The foams 52 and 53 received in the second pad portion 22 and the third pad portion 23 are HR foams configured to increase the supporting strength and working life. Alternatively, the foams 52 and 53 can be memory foams or inert foams. FIG. 1 only shows a foam 51, a foam 52 and a foam 53 for the left half of the inner case 4 while a foam 51, a foam 52 and a foam 53 for the right half of the inner case 4 have been received in the inner case 4. It is worth mentioning that the first pad portions 21 at the center of the multi-functional supporting cushion 1 are higher than the second pad portions 22 and the third pad portions 23 at both sides, and that the second pad portions 22 are higher than the third pad portions 23. The top ends of the first pad portions 21, the second pad portion 22 and the third portion 23 form a wave-shaped contour descending from the center toward both sides. A bolster is selectively formed from the first pad portions 21, the second pad portions 22 and the third pad portions 23 as shown in FIG. 2, or the plurality of pad portions are constricted from respective free ends of the third pad portions 23 at both sides to make a circular loop as shown in FIG. 3, a perspective view showing a multi-functional supporting cushion of the present invention under the state of being used.

Figure 4:
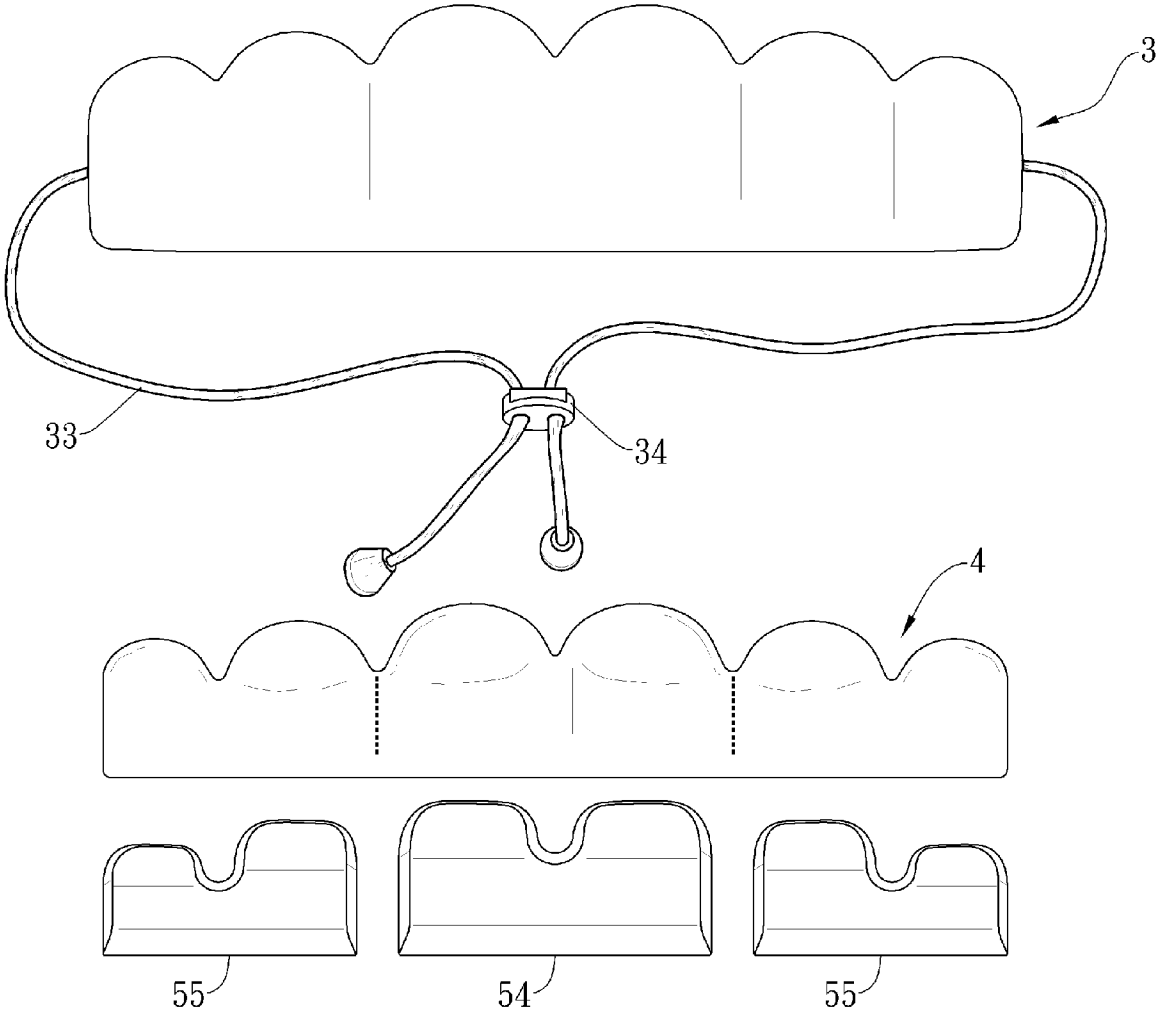
FIG. 4 is an exploded view of a multi-functional supporting cushion in accordance with another embodiment of the present invention.

FIG. 4 is an exploded view showing a multi-functional supporting cushion in accordance with another embodiment of the present invention. The embodiments shown in FIGS. 1 and 4 are different in that the foam 51 and the foam 54 are of different shapes but made of the same material. The foam 54 received in the first pad portion 21 is a memory form or an inert foam. The foams 55 and the foams 52 and 53 are of different shapes but made of the same material. The foams 55 received in the second pad portion 22 and the third pad portion 23 are HR foams. Alternatively, the foams 55 can be memory foams or inert foams.

Figure 5:
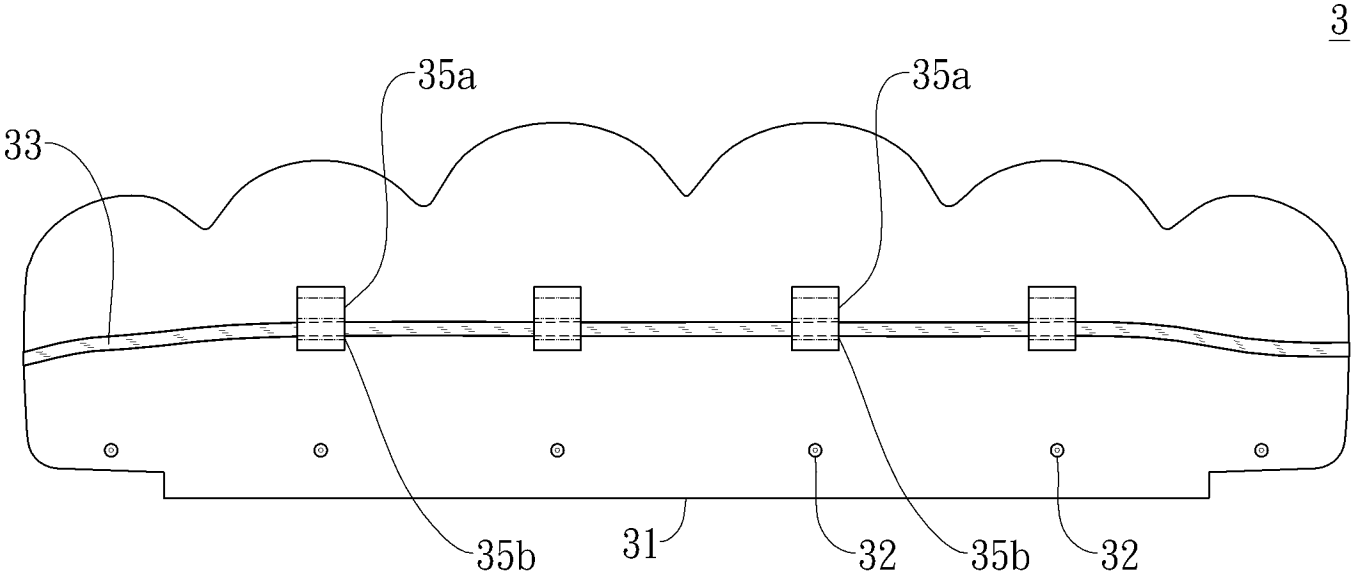
FIG. 5 is a schematic representation showing an interior surface of an outer case.
Figure 6:
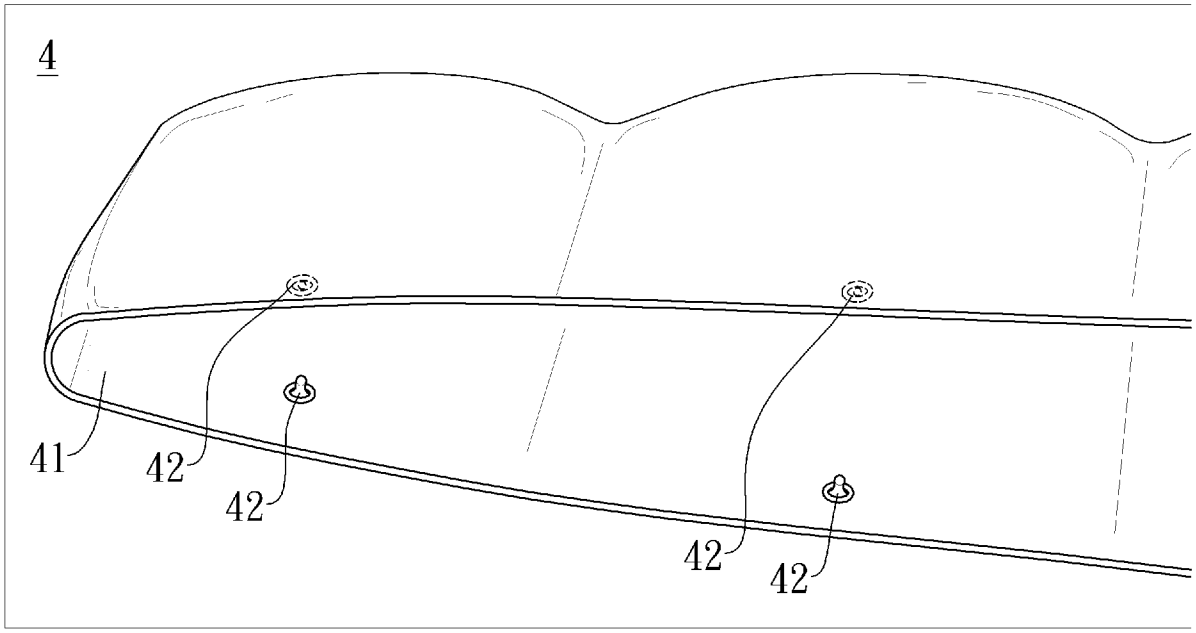
FIG. 6 is a partial perspective view of an inner case.

FIGS. 5 and 6 are a schematic representation showing an interior surface of an outer case 3 and a partial perspective view of an inner case 4. The outer case 3 has a first opening 31 defined at the lower end thereof, and a plurality of first joining elements 32 are provided at the first opening 31. Preferably, the plurality of first joining elements 32 of the outer case 3 are buttons. In other embodiments, the plurality of first joining elements 32 of the outer case 3 can be Velcro patches or other joining elements. The inner case 4 has a second opening 41 defined at the lower end thereof, and a plurality of second joining elements 42 are provided at the second opening 41. Preferably, the plurality of second joining elements 42 of the inner case 4 are buttons. In other embodiments, the plurality of second joining elements 42 of the inner case 4 can be Velcro patches or other joining elements. The plurality of first joining elements 32 and the plurality of second joining elements 42 are configured such that the foams 51, 52 and 53 or the foams 54 and 55 can be prevented from being exposed from the second opening 41 when being received in the inner case 4.

Referring to FIG. 5 and FIG. 2, the outer case 3 comprises a string 33 and a fastening element 34. A plurality of string through holes 35 are defined on the interior surface of the outer case 3, and the string 33 is threaded through the outer case 3, the plurality of string through holes 35 and the fastening element 34. The cushion 1 can be constricted by drawing up the string 33 and clasping the string 33 with the fastening element 34. Preferably, the plurality of string through holes 35 are arranged at different heights so that the height position of the string 33 can be adjusted to achieve different supporting effects when the string 33 is threaded through the plurality of string through holes 35 arranged at different heights. The user can make the adjustment according to his/her needs. The upper string through holes 35*a* and the lower string through holes 35*b* are shown in FIG. 5. For example, the string 33 is threaded through the string through holes 35*b* at lower heights, as shown in FIG. 5.

Referring again to FIGS. 2 and 3, when the multi-functional supporting cushion 1 of the present invention is in the state as shown in FIG. 2, the user firstly uses fingers to hold the fastening element 34, and then pulls the string 33 in a direction away from the fastening element 34 to constrict the first pad portions 21, the second pad portions 22 and the third pad portions 23 to make a circular loop as shown in FIG. 3.

Figure 7:
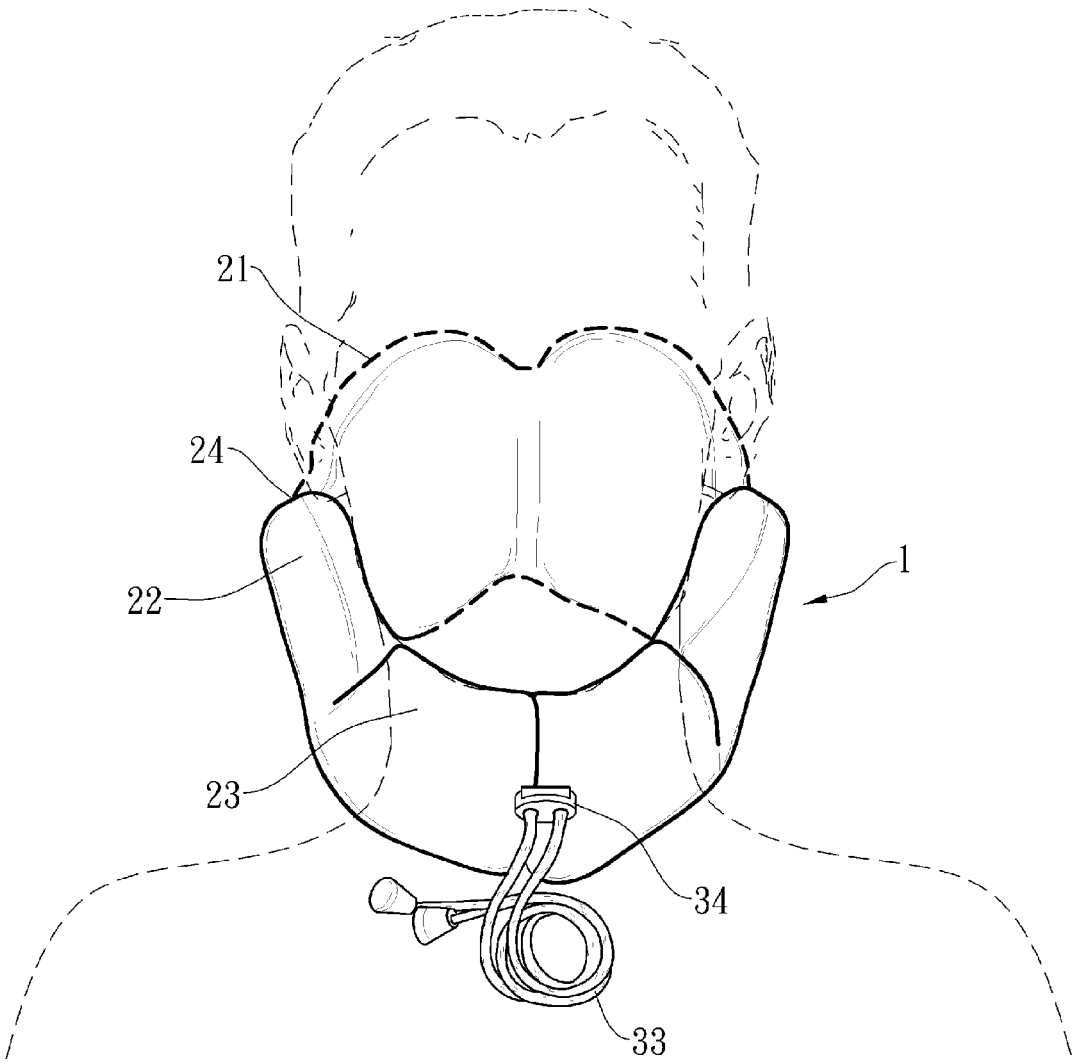
FIG. 7 is a schematic representation showing a user using a multi-functional supporting cushion of the present invention.

FIG. 7 is a schematic representation showing a user using a multi-functional supporting cushion 1 of the present invention. When the multi-functional supporting cushion 1 is placed around the user's neck, the first pad portions 21 support the nape of the neck, the second pad portions 22 are positioned at the sides of the neck, the third pad portions 23 are positioned at the front of the neck (i.e. under the chin), and the recesses 24 defined between the first pad portions 21 and the second pad portions 22 accommodate the user's ears. The user will feel very comfortable with the support of the foams 51 in the first pad portions 21, and the multi-functional supporting cushion 1 can also support the head so that the neck can be protected from any harm caused due to the swing of the head to the left or right. The arrangement of the recesses 24 between the first pad portions 21 and the second pad portions 22 to accommodate the user's ears is a considerate design to make the user more comfortable.

Figure 8:
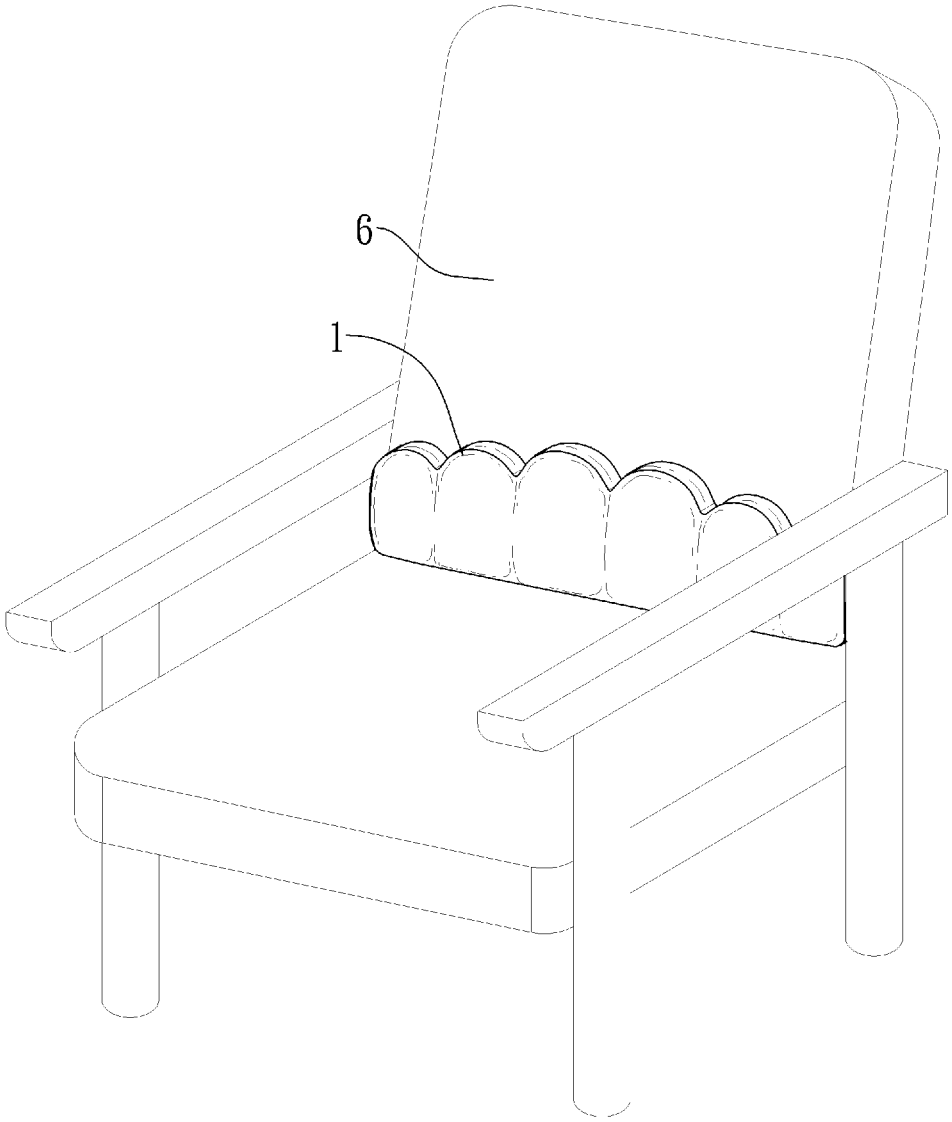
FIG. 8 is a schematic representation showing a multi-functional supporting cushion of the present invention being placed on a chair.

FIG. 8 is a schematic representation showing a multi-functional supporting cushion 1 of the present invention being placed on a chair 6. The multi-functional supporting cushion 1 of the present invention can be placed on the chair 6. The user can adjust the position of the multi-functional supporting cushion 1 to rest his/her waist or back thereon when sitting on the chair so that the user's waist or back will feel comfortable due to the support from the special function of the foams 51, 52 and 53 or the foams 54 and 55 filled in the first pad portions 21, the second pad portions 22 and the third pad portions 23.

Figure 9:
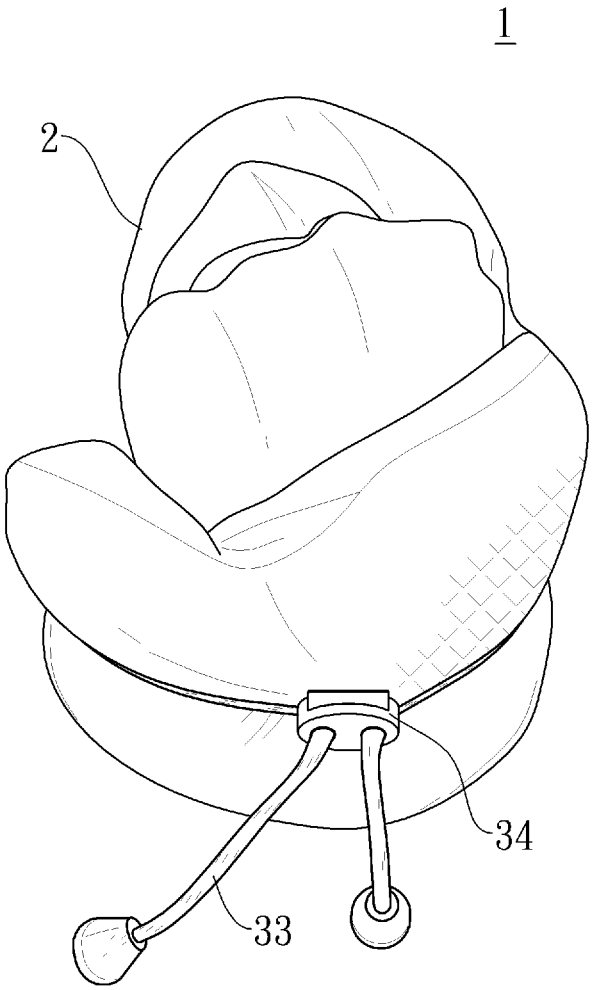
FIG. 9 is a perspective view showing a multi-functional supporting cushion of the present invention in a constricted state.
Figure 10:
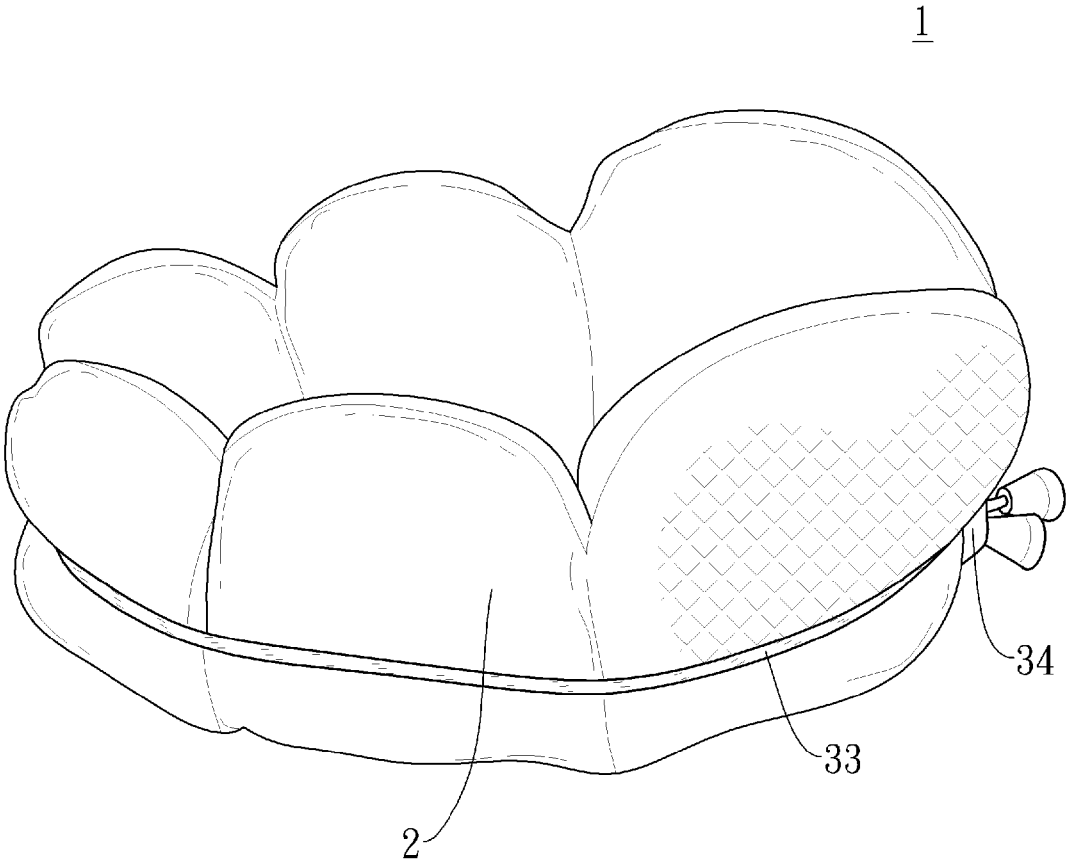
FIG. 10 is a perspective view showing a multi-functional supporting cushion of the present invention in another constricted state.

FIGS. 9 and 10 are perspective views showing a multi-functional supporting cushion 1 of the present invention in different constricted states. When the user wants to store the multi-functional supporting cushion 1, the flexibility of the foams 51, 52 and 53 or the foams 54 and 55 allows the first pad portions 21, the second pad portions 22 and the third pad portions 23 to be folded and compressed to a smaller size for storage.

While this invention has been described by way of preferred embodiments, it is to be understood that this invention is not limited hereto, and that various changes and alterations can be made herein by those skilled in the art without departing from the spirit and scope of this invention as defined by the appended claims.

What is claimed is:

1. A multi-functional supporting cushion, comprising: a plurality of pad portions, each of which having a circularly curved top end, the pad portions at a center being higher than those adjacent thereto such that top ends of the plurality of pad portions form a wave-shaped contour descending outside from the center, a bolster being selectively formed from the plurality of pad portions or the plurality of pad portions being constricted from respective free ends of the two pad portions at both sides to make a circular loop, wherein the plurality of pad portions of the cushion comprise an outer case, an inner case and at least one foam received in the inner case, and wherein the at least one foam and the inner case are received in the outer case, the outer case comprises a string and a fastening element and an interior surface thereof is defined with a plurality of string through holes, wherein the string is threaded through the outer case, the plurality of string through holes and the fastening element, and wherein the cushion can be constricted by drawing up the string and clasping the string with the fastening element, the string is threaded through the plurality of string through holes arranged at different heights on the outer case so as to adjust a height position of the string.

2. The multi-functional supporting cushion according to claim 1, wherein the outer case has a first opening at which at least one first joining element is provided, and wherein the inner case has a second opening at which at least one second joining element is provided.

3. The multi-functional supporting cushion according to claim 1, wherein the at least one foam is a memory foam.

4. The multi-functional supporting cushion according to claim 1, wherein the at least one foam is a high resilience (HR) foam.

5. The multi-functional supporting cushion according to claim 1, wherein the plurality of pad portions comprise a first pad portion, a second pad portion and a third pad portion, and wherein a recess is defined between the first pad portion and the second pad portion to accommodate a user's ear.

6. The multi-functional supporting cushion according to claim 2, wherein the at least one first joining element of the outer case is a button, and wherein the at least one second joining element of the inner case is a button.

7. The multi-functional supporting cushion according to claim 2, wherein the at least one first joining element of the outer case is a hook and loop fastener, and the at least one second joining element of the inner case is a hook and loop fastener.

* * * * *